United States Patent [19]

Bezin et al.

[11] Patent Number: 4,893,420

[45] Date of Patent: Jan. 16, 1990

[54] CYCLIST'S SHOE

[75] Inventors: Michel Bezin, Nevers; Yves Boisot, Varennes-Vauzelles, both of France; Otto Harsányi, Leonberg, Fed. Rep. of Germany

[73] Assignee: Look S.A., Nevers Cedex, France

[21] Appl. No.: 209,712

[22] Filed: Jun. 22, 1988

[30] Foreign Application Priority Data

Jul. 6, 1987 [EP] European Pat. Off. ..... 87109717.6

[51] Int. Cl.[4] ..... A43B 5/14

[52] U.S. Cl. ..... 36/131; 36/132; 74/594.6

[58] Field of Search ..... 36/131, 132, 117; 74/594.6, 594.4

[56] References Cited

U.S. PATENT DOCUMENTS

| | | | |
|---|---|---|---|
| 598,325 | 2/1898 | McIntyre | 36/131 X |
| 4,188,737 | 2/1980 | Haver . | |
| 4,298,210 | 11/1981 | Lotteau et al. . | |
| 4,351,120 | 2/1982 | Daleboot | 36/117 |
| 4,488,453 | 12/1984 | Drugeon et al. | 74/594.6 |
| 4,538,480 | 9/1985 | Trindle | 36/131 X |
| 4,662,090 | 5/1987 | Solano . | |
| 4,686,867 | 8/1987 | Bernard et al. | 74/594.6 |

FOREIGN PATENT DOCUMENTS

| | | | |
|---|---|---|---|
| 0153210 | 8/1985 | European Pat. Off. | 36/131 |
| 0193472 | 9/1986 | European Pat. Off. | 36/131 |
| 2240102 | 2/1974 | Fed. Rep. of Germany . | |
| 3135346 | 5/1983 | Fed. Rep. of Germany | 36/131 |
| 2279607 | 2/1976 | France . | |
| 2432427 | 2/1980 | France . | |
| 2464661 | 3/1981 | France | 36/131 |
| 2442175 | 10/1982 | France . | |
| 2555417 | 5/1985 | France | 36/131 |

*Primary Examiner*—James Kee Chi

*Attorney, Agent, or Firm*—Townsend and Townsend

[57] ABSTRACT

A pedal plate (13) for a cycle safety pedal (26) is releasably attached to the sole (12) of a cyclist's shoe in the ball region and has a running surface which extends parallel to the attachment region on the sole. The attachment region (11) of the sole (12) is arranged recessed by the thickness of the pedal plate (13) relative to the base surface of the sole (36) around the attachment region (11), so that the bottom of the pedal plate lies substantially flush with the bottom of the sole.

34 Claims, 6 Drawing Sheets

CYCLIST'S SHOE

Figure 1:
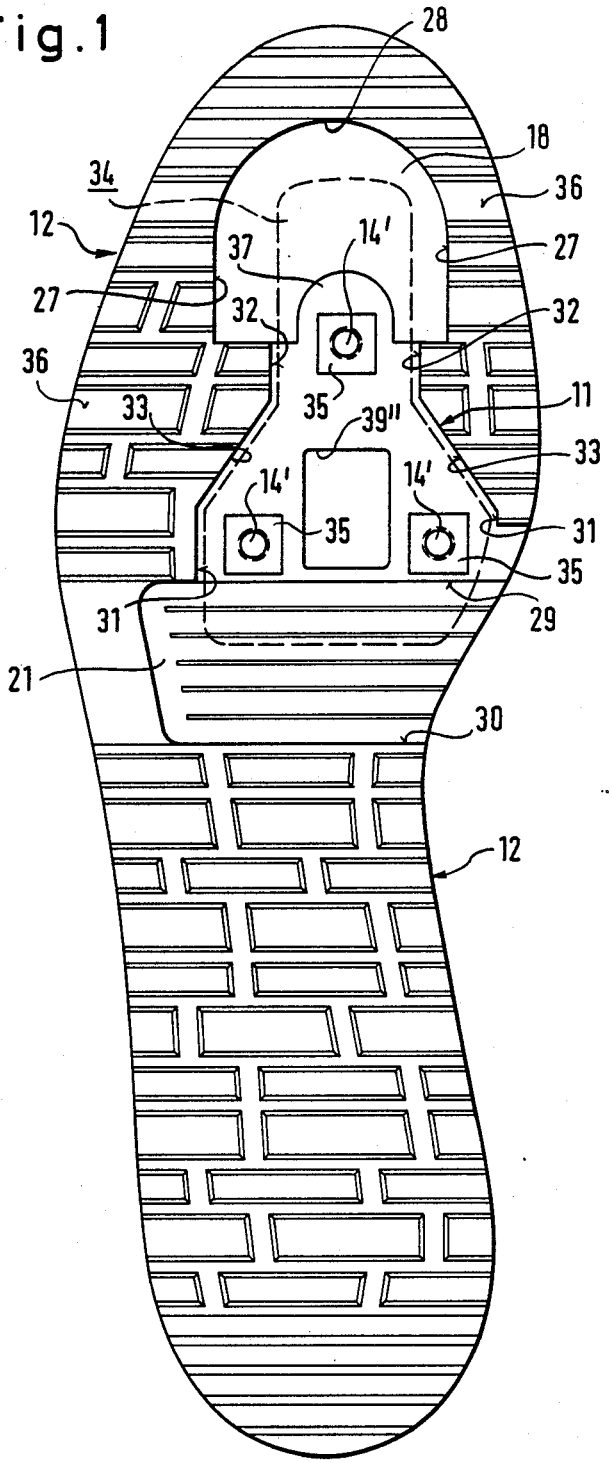

The invention relates to a cyclist's shoe having a sole to which the pedal plate of a cycle safety pedal is preferably releasably attached in the ball region, the sole having a base surface extending substantially parallel to the region of attachment of the pedal plate to the sole.

More particularly the invention relates to a cyclist's shoe having a pedal plate for releasable engagement with the cycle safety pedal, the cycle safety pedal having an engagement projection at the front which is spaced from the pressure surface of the pedal and a pedal latch at the rear which is also spaced from the pressure surface of the pedal, so that on placing the pedal plate substantially from above onto the cycle safety pedal, and on latching of the pedal plate into the latter, a locked engagement of the pedal plate on the cycle safety pedal can be effected with respect to vertical forces, and separation of the pedal plate from the cycle safety pedal can be effected by rotation of the pedal plate about a vertical axis.

In known cyclist's shoes of this kind (EP-OS Nos. 146 454 and 153 210), which are in particular provided for racing cyclists, the pedal plate is screwed onto the base surface of the sole of the shoe. The pedal plate thus hinders walking with such a cyclist's shoe, and indeed even when the lower surface of the pedal plate is largely matched to the shape of the sole part located above it. This is particularly unpleasant for a cyclist when he is riding a so-called mountain bike or is taking part in a cross-field race, since in these cases the cyclist is only moving for some of the time on his cycle, while at other times he has to push or indeed carry the cycle. For this he actually requires a cross-country shoe.

The object of the present invention is thus not only to provide a cyclist's shoe of the initially named kind which can be reliably connected in the customary manner with a cycle safety pedal, and can also be released from the latter when required, but also to provide a cyclist's shoe having a pedal plate which hardly hinders normal walking with the shoe.

In order to satisfy this object the present invention provides that the attachment region of the sole is recessed relative to the base surface of the sole by substantially the thickness of the pedal.

A particularly preferred embodiment, which is particularly useful when the cycle safety pedal has an engagement projection at the front and a pivotable latch at the rear, is characterized in that recesses are provided in front of and behind the pedal plate in the sole to provide free spaces for the components of the cycle safety pedal which move into and out of engagement with a counter-projection and a counter-latch of the pedal plate.

The basic concept underlying the invention is thus to be seen in the fact that the pedal plate which is in any event generally made as thin as possible is to be recessed into the sole of the shoe in such a way that in practice it does not, or at most only fractionally projects downwardly beyond the base surface of the sole. In order that the cooperation of the pedal plate with the cycle safety pedal is not hindered adequate free spaces are also provided in the regions around the pedal plate where the cycle safety pedal engages and also serve for engagement with the safety pedal or for release from the cycle safety pedal.

The embodiment with recesses to the front and rear of the attachment region also combines adequate free space for a pedal engaging projection with flexibility of the sole, and thus the bending behaviour of the shoe in the sole region is favourably influenced. The additional recessing relative to the attachment region is preferably approximately 2 mm.

The front recess preferably has sidewalls extending substantially parallel to the longitudinal axis of the shoe and a substantially semi-circular front wall.

The rear recess preferably adjoins the attachment region and is clearly recessed relative to the latter, preferably by approximately 4 mm.

In a particular preferred embodiment the rear recess extends over substantially the entire width of the sole, with the front and rear boundaries of the recess preferably extending transverse to the longitudinal axis of the shoe and permitting the release of the shoe from the pedal.

The cyclist's shoe of the invention is advantageously provided with a pedal plate which can be screwed in place, i.e. which is also releasable.

The pedal plate and the attachment region preferably have in plan view essentially the form of a triangle, in particular an equilateral triangle with its apex pointing towards the front, and screw holes for the attachment of the pedal plate to the attachment region.

In this arrangement one screw hole is arranged at the front and two screw holes are preferably arranged at the rear alongside one another.

Moreover, the pedal plate and the attachment region expediently have side restraints in the rear portion which extend substantially parallel to the longitudinal axis of the shoe, with it being possible to drop one side restraint in the attachment region due to approximation to the edge of the sole. Further side restraints are provided in the front region of the shoe, have a small distance from one another and extend parallel to the longitudinal axis of the shoe. Transitional side restraints are also provided which extend inclined to the longitudinal axis of the shoe between the first said side restraints and the further side restraints.

In a particularly preferred embodiment a reinforcement insert having a lower side forming said attachment region is preferably molded into the sole in the ball region, with the reinforcement insert being of flat shape in the attachment region. This reinforcement insert compensates for the fact that the sole of the shoe will otherwise be weakened by the recesses in the region of the pedal plate, i.e. in front of and behind the pedal plate. Particularly preferred forms of the insert are set forth in claims 11 to 27.

In particular the reinforcement insert preferably consists of hard elastic plastic and has metal inserts containing threaded bores for the screws securing the pedal plate to the attachment region. Alternatively, the reinforcement insert may consist of metal and may be thickened in the region of the threaded bores. These two constructions mean that the insert is less elastic and harder than the sole of the shoe itself but is nevertheless flexible, in particular in the thinner regions so that it is possible to walk with the shoe in practically the same manner as if the customary elastic throughgoing sole were provided.

The downwardly projecting edges of the insert and the regions which project outwardly beyond them including the anchorage bores are of particular importance for troublefree anchorage of the reinforcement insert into the sole of the shoe. In the attachment region, and in the region of the front and rear recesses, the reinforcement insert itself forms the floor of the sole. The lower surface of the reinforcement insert can however be partially covered over, at least in the edge region, by relatively thin layers of the sole material.

The lesser thickness of the reinforcement insert relative to the thickness of the sole of the shoe is compensated for by the greater hardness or strength of the reinforcement insert relative to the sole material, so that the overall stability of the sole is not impaired by the provision of the recesses and depressions.

In a development of the invention a cover plate is provided in the region of the pedal plate and is releasably securable to the latter. The cover plate is preferably capable of being clipped onto the pedal plate and indeed preferably also largely covers over the front recess. Alternatively the pedal plate may be formed in one piece with the cover plate with the part so formed being securable to the sole of the shoe, and indeed being preferably screwable thereto instead of a pedal plate which cooperates with the cycle safety pedal.

The cover plate brings the advantage that in normal walking or running the pedal plate is covered over from below so that, for example, the screw holes cannot be made dirty. This embodiment is thus suitable for the case in which one has to walk with the shoe for a longer period of time.

For this purpose an embodiment is expedient where the depression and recesses in the sole of the shoe are practically closed by a plate piece of complementary shape, with this plate piece having recessed screw bores which have the same arrangement as those of the pedal plate. The shoe can in this way be converted by removal of the pedal plate and screwing on of the filling plate piece into a quite normal shoe with an essentially smooth continuous sole.

Figure 2:
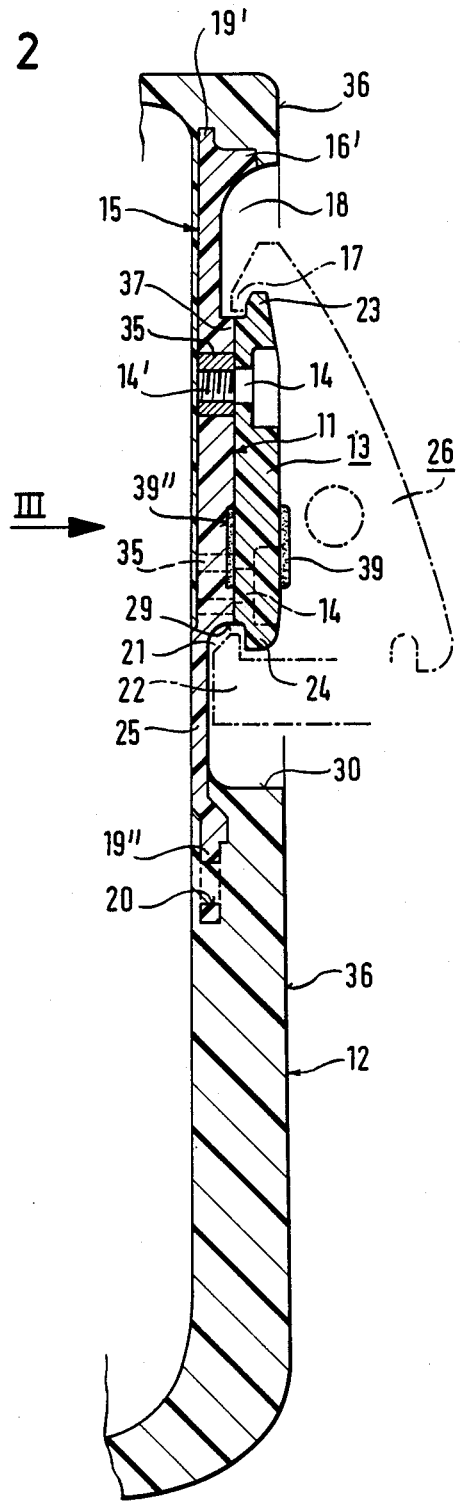

The invention will now be described in the following by way of example and with reference with the drawings which show:

FIG. 1 a view of a cyclist's shoe in accordance with the invention from below,

FIG. 2 a vertical central longitudinal section of the subject of FIG. 1 with the cycle safety pedal also being schematically indicated in chain-dotted lines, FIG. 3 a view from below of the reinforcement insert used with the cyclist's shoe of the invention, FIG. 4 a view from above of the pedal plate used in conjunction with the reinforcement insert of FIG. 3, FIG. 5 a side view of the reinforcement insert in accordance with the arrow V in FIG. 3, FIG. 6 a section on the line VI—VI in FIG. 3, FIG. 7 a view from below of the pedal plate used with the reinforcement insert of FIG. 3, and FIG. 8 a view corresponding to FIG. 3 but of a simplified embodiment of the reinforcement insert.

In accordance with the FIGS. 1 and 2 the sole 12 of a cyclist's shoe has an essentially triangular attachment region 11 which, in accordance with FIG. 2 is arranged recessed relative to the base surface 36 of the sole 12 and which is substantially flat. The depth of the recess of the attachment region 11 relative to the base surface 36 amounts to approximately 10 mm so that a pedal plate 13 with a thickness of approximately 10 mm can be attached there without having to project downwardly beyond the base or running surface 36 of the sole.

Figure 3:
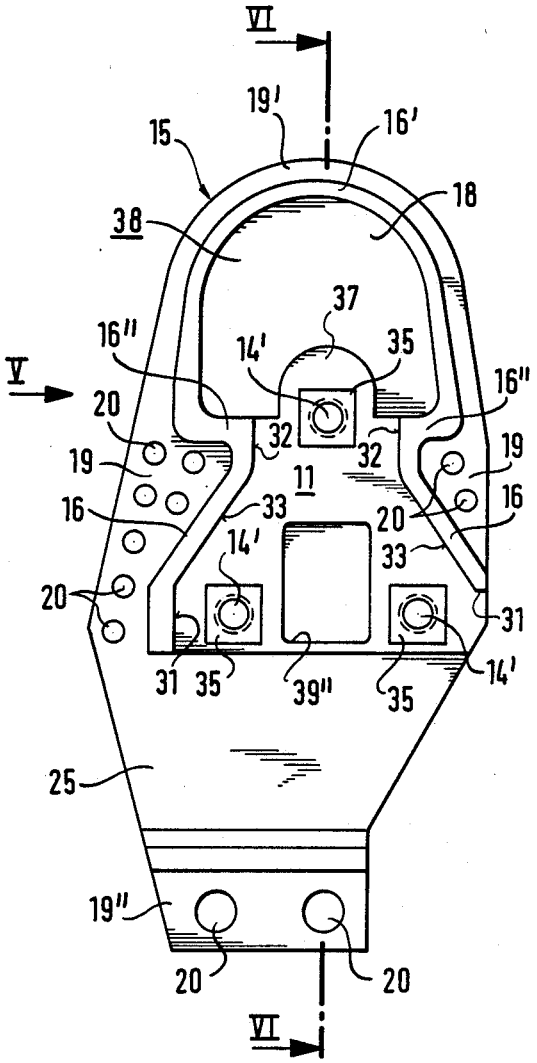
Figure 5:
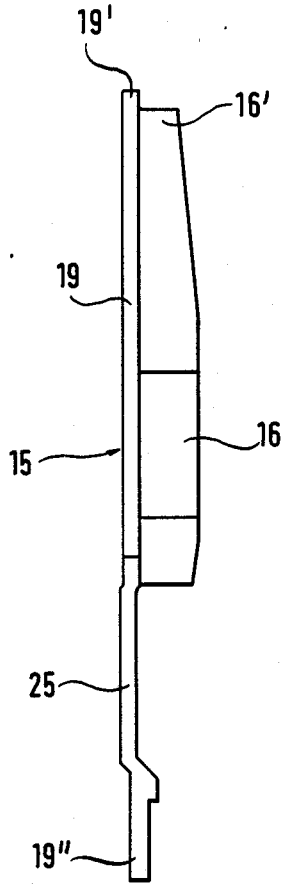
Figure 6:
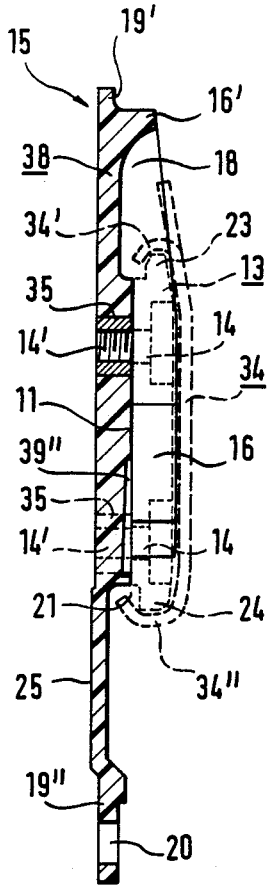

In accordance with the invention the attachment region 11 is provided on a reinforcement insert 15 which is illustrated in detail in the FIGS. 3, 5 and 6 and which is so molded into the material of the sole 12 that the attachment region 11 is formed in accordance with FIGS. 1 and 2 by the lower surface of the reinforcement insert 15.

In accordance with the FIGS. 1, 2, 3, 5 and 6 metallic inserts 35 are molded into the attachment region 11 of the reinforcement insert 15, which consists of a hard elastic plastic. The metal inserts 35 have threaded bores 14' which are open towards the bottom. Of these metallic inserts 35 or threaded bores 14' one is located at the front end of the attachment region 11 while at the rear two metallic inserts 35 with threaded bores 14' are molded alongside one another into the reinforcement insert 15.

Figure 4:
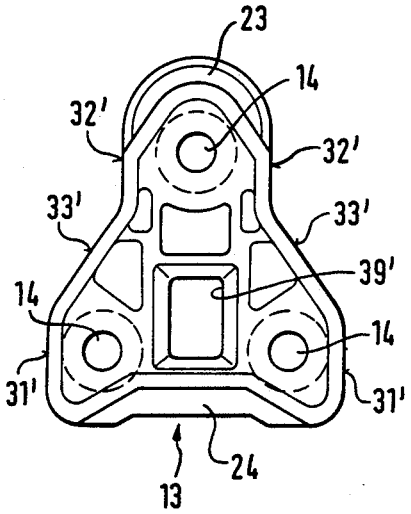
Figure 7:
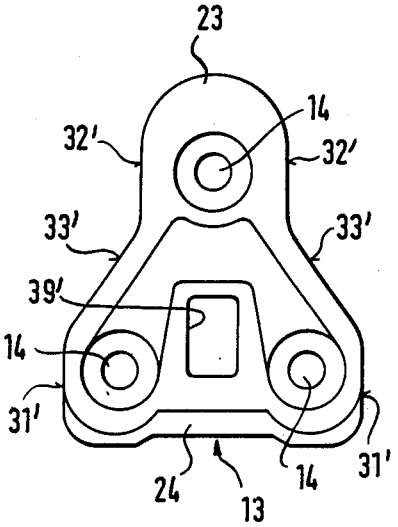

The attachment region 11 is shaped in plan view analogously to the pedal plate which is to be mounted thereon in accordance with FIGS. 4 and 7, i.e. two side restraints 31 having a relatively large spacing are provided in the rear region, of which however the right hand side restraints 31 in FIG. 3 is only partially present or can indeed be omitted fully. Two further side restraints 33 which taper towards the front in wedge-like manner adjoin the side restraints 31 and merge further to the front into two side restraint portions 32 which have a small lateral spacing and extend parallel to the longitudinal axis of the shoe. The pedal plate 13 has correspondingly disposed side restraints 31', 32' and 33' as can be seen in FIGS. 4, 7.

In front of the side restraints 32 the attachment region 11 has a forwardly projecting substantially semi-circular projection 37 which cooperates with a corresponding projection of the pedal plate 13 in accordance with FIGS. 4 and 7. In this manner a substantially planar attachment region 11 is provided on which a pedal plate 13 in accordance with FIGS. 4 and 7 can be secured in accordance with FIGS. 2 and 6, the pedal plate having recessed screw holes 14 which are aligned with the threaded bores 14' when the pedal plate 13 is mounted onto the attachment region 11. The pedal plate 13 can be attached to the attachment region 11 by screwing in attachment screws which are not illustrated. After the screwing in of the attachment screws the heads of the attachment screws do not project beyond the lower surface of the pedal plate 13.

In accordance with FIGS. 2, 3, 5 and 6 the attachment region 11 is surrounded by two vertically downwardly projecting edges 16, the path of which is matched to the side restraints 31, 32, 33 of the attachment region 11, which are however displaced outwardly somewhat further than these side restraints so that they can be molded into the material of the sole 12.

The edges 16 merge via edge regions 16" which project outwardly to opposite sides from the front ends of the edges 16 into a front edge 16' which extends in substantially semicircular manner around a recess 18 and is likewise molded into the material of the sole 12 in a position where it has its normal thickness. In this manner a recess 18 is also provided in front of the attachment region 11 in accordance with FIG. 1 which is approximately 2 mm deeper than the attachment region 11 and is likewise bounded by the lower surface of the reinforcement insert 15. The edge 16' is so shaped that the recess 18 in accordance with FIG. 1 has two sidewalls 27 which extend substantially in the longitudinal direction of the shoe which are however connected towards the front by a semicircular wall 28. Thus the reinforcement insert in accordance with FIGS. 3 and 6 has a front extension in the region of the recess 18 which is somewhat thinner than the attachment region 11.

Through the recess 18 in accordance with FIG. 2 a free space is formed which permits the engagement of a fixed engagement projection 17 of the cycle safety pedal 26 behind a front counter-projection 23 of the pedal plate 13.

Behind the attachment region 11 the reinforcement insert 15 has a somewhat thinner extension 25 which extends approximately to the center of the sole 12 and merges at the end into a thin support region 19'' which has anchorage bores 20. The extension 25 is molded into the material of the shoe sole and indeed preferably in such a way that the underside of the extension 25 simultaneously forms the floor of the sole.

In this manner a recess 21 is formed in the sole 12 behind the attachment region 11 in FIGS. 1 and 2 and is closed off by front and rear boundaries 29 and 30 which extend transverse to the longitudinal axis of the shoe.

In accordance with FIGS. 2 and 6 the recess 21 behind the attachment region 11 ensures that a movable pedal latch 22 of the cycle safety pedal 26, which can pivot resiliently outwardly about a transverse axle, can latch into a rear counter-latch 24 of the pedal plate 13.

In accordance with FIGS. 2 and 3 the reinforcement insert 15 also has lateral support regions 19 and a front support region 19' which extend beyond the downwardly projecting edges 16, 16', 16'' and which are aligned with the attachment region 11. Anchorage bores 20 are provided in the lateral support regions 19. The lateral support regions 19 practically fill out the space which is still present as a result of the tapering of the side restraints 33 towards the front. The support regions 19, 19' which are likewise molded into the material of the sole 12 are of particular importance for trouble-free anchorage of the reinforcement insert 15 into the material of the sole In accordance with FIGS. 5 and 6 the upper side of the reinforcement insert 15 is of substantially flat construction, with only the extension 25 (with the exception of this support region 19'') extending somewhat further upwardly in order to realise a somewhat greater depth of the recess 21.

The manufacture of the cyclist's shoe of the invention takes place in such a way that the reinforcement insert 15 is applied in the correct arrangement to the welt and is secured there for example by adhesive with the edges 16, 16', 16'' projecting downwardly. The material of the sole is then molded on from below however with the recesses 18, 21 and also the recess in the attachment region 11 which are in particular evident from FIG. 1 being kept free of sole material.

The pedal plate 13 is then secured to the mounting region 11 by means of screws in accordance with FIGS. 4 and 7. In accordance with FIGS. 2 and 6 the pedal plate 13 now practically does not project beyond the base surface 36 of the sole 12, so that one can walk normally with the shoe. The shoe sole is of relatively stiff construction in the attachment region 11 in particular as a result of the arrangement of the pedal plate 13. The recesses 18, 21 before and behind the pedal plate 13 however have the effect that the sole as a whole has increase bending elasticity here, so that on the whole a rolling off movement of the foot is possible during walking in approximately the same way as with a normal shoe.

At the same time the cyclist's shoe can however now be inserted in the manner evident from FIG. 2 from above into a cycle safety pedal 26 and can be latched in place by resilient backward pivoting and subsequent advance of the pedal latch 22 so that a fixed connection is present between the cyclist's shoe and the cycle safety pedal 26 which in particular makes powerful lifting of the cycle safety pedal 26 during cycling possible. By rotation of the cyclist's shoe about a vertical axis it is possible to release it from the safety pedal 26 in a simple manner and indeed by lateral movement of the engagement projection 17 and the pedal latch 22 in opposite directions.

As indicated in broken lines in FIGS. 1 and 6 a cover plate 34 can be snapped onto the pedal plate 13 which has resilient latch recesses 34', 34'' at its upper side which can enter into an releasable latch engagement with the counter-projection 23 and the counter-latch 24 of the pedal plate respectively. In accordance with FIG. 1 the cover plate 34 can be so constructed that it fully covers the pedal plate 13 and at least partially covers the recesses 18, 21.

The cover plate 34 admittedly projects fractionally beyond the base surface 36 of the shoe sole however it nevertheless permits comfortable walking because of its relatively thin construction and protects the screw holes 14 against contamination.

The cover plate 34 could be in one piece with the pedal plate 13 however the projection evident from FIG. 6 could then avoided and the screw holes 14 could emerge from the lower side of the cover plate 34. A cover plate of this layout could be screwed into the attachment region 11 in place of the pedal plate 13 so that a shoe is then present which can be used in practically normal manner.

A rubber buffer 39 can be inserted into the rectangular opening 39' of the pedal plate 13 (FIGS. 4 and 7) in accordance with FIG. 2, with the rubber buffer being braced at the base of the reinforcement insert 15 in a correspondingly rectangularly shaped recess 39'' provided there (FIG. 1) and projects downwardly fractionally beyond the pedal plate 13.

Figure 8:
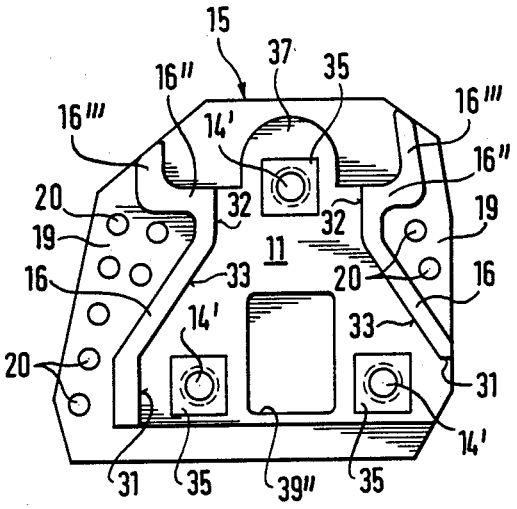

In the embodiment of FIG. 8 the front extension 38 and the rear extension 25 of the insert 15 are omitted apart from regions which respectively project to the front and to the rear fractionally beyond the attachment region 11. In this manner anchorage edges 16''' which only project fractionally forwardly adjoin the laterally outwardly projecting edge region 16'' and likewise ensure a good anchorage within the material of the shoe sole. For the purpose of engagement of the pedal plate 13 the recesses 18 and 21 in accordance with FIGS. 1 and 2 are however provided even when using the reinforcement insert 15 of FIG. 8. As a result of the shortened construction of the reinforcement insert 15 of FIG. 8 a more favourable bending behaviour is obtained in the front and middle regions of the shoe sole.

In a simplified embodiment the edges 16, 16' 16'' and/or 16''' could basically be omitted, in which case particular importance is then attached to the anchorage regions to the side of the recesses.

We claim:

1. Cyclist's shoe for use with a cycle safety pedal having a pressure surface, a front end, a rear end, an engagement projection at said front end with said engagement projection being spaced from said pressure surface, and a pedal latch at said rear end with said pedal latch being spaced from said pressure surface; said shoe comprising a sole having a base surface, a recess in said sole, an attachment region within said recess and extending substantially parallel to said base surface, and a pedal plate which in use confronts said pressure surface having a thickness and attached to said attachment region, with said attachment region being recessed relative to said base surface by an amount substantially equal to the thickness of said pedal plate; respective front and rear spaces in said recess at the front and rear of said pedal plate respectively; a counter-projection capable of cooperating with said engagement projection located at said front of said pedal plate; a counter-latch capable of cooperating with said pedal latch at said rear of said pedal plate; said front and rear spaces accommodating said engagement projection and said pedal latch respectively and permitting movement thereof into and out of engagement with said counter-projection and said counter-latch respectively, whereby, on latching of said pedal plate on said cycle safety pedal, a locked engagement of the pedal plate is effected with respect to vertical forces, with separation of the pedal plate from the safety pedal being effected by rotation of the pedal plate about a vertical axis.

2. Cyclist's shoe in accordance with claim 1, characterized in that the front recess adjoins the attachment region and is somewhat further recessed relative to the latter.

3. Cyclist's shoe in accordance with claim 2, characterized in that said front recess has sidewalls extending substantially parallel to the longitudinal axis of the shoe and a substantially semicircular front wall.

4. Cyclist's shoe in accordance with claim 1, characterized in that the rear recess adjoins the attachment region and is clearly recessed relative to the latter.

5. Cyclist's shoe in accordance with claim 5, characterized in that the rear recess extends over substantially the entire width of the sole, with the front and rear boundaries of the recess extending transverse to the longitudinal axis of the shoe and permitting the release from the pedal.

6. Cyclist's shoe in accordance with one of the preceding claims having a pedal plate which can be screwed on, characterized in that the pedal plate and the attachment region having in plan view essentially the form of a triangle, in particular an equilateral triangle with its apex pointing towards the front, and screw holes for the attachment of the pedal plate to the attachment region.

7. Cyclist's shoe in accordance with claim 6, characterized in that one screw hole is arranged at the front and two screw holes are arranged at the rear alongside one another.

8. Cyclist's shoe in accordance with claim 6, characterized in that the pedal plate and the attachment region in the rear portion have spaced apart side restraints which extend substantially parallel to the longitudinal axis of the shoe, with it being possible to drop one side restraint in the attachment region due to approximation to the edge of the sole; in that further side restraints are provided in the front region of the shoe which have a small distance from one another and which extend parallel to the longitudinal axis of the shoe; and in that transitional side restraints are provided which extend inclined to the longitudinal axis of the shoe between the first said side restraints and the further side restraints.

9. Cyclist's shoe in accordance with claim 1, characterized in that a reinforcement insert having a lower side forming said attachment region is molded into the sole in the ball region, with the reinforcement insert being of flat shape in the attachment region.

10. Cyclist's shoe in accordance with claim 9, characterized in that the reinforcement insert has a downwardly projecting edge at least to the side of the attachment region, the attachment region having spaced apart side restraints, with said edge extending at a small distance parallel to the side restraints of the attachment region and being molded into the sole alongside the attachment region.

11. Cyclist's shoe in accordance with claim 10, characterized in that the reinforcement insert furthermore extends to the front and/or to the rear by only a small amount beyond the attachment region.

12. Cyclist's shoe in accordance with claim 11, characterized in that said edges which are located to the side of the attachment region merge at their front ends via a transversely outwardly and likewise downwardly projecting edge region into two slightly forwardly projecting and likewise downwardly projecting edges.

13. Cyclist's shoe in accordance with claim 9, characterized in that said reinforcement insert extends over the front recess and there forms the base of the sole.

14. Cyclist's shoe in accordance with claim 13, characterized in that the part of the reinforcement insert which extends beyond the front recess is surrounded at the side and at the front by a downwardly projecting edge portion molded into the sole material.

15. Cyclist's shoe in accordance with claim 14, characterized in that said edges and said edge portion merge into one another.

16. Cyclist's shoe in accordance with claim 15, characterized in that a step-like, outwardly projecting, edge transition region is provided between each side edge and said edge portion.

17. Cyclist's shoe in accordance with claim 16, characterized in that said reinforcement insert extends beyond the attachment region, the side edges, the edge portion and the edge transition region to the side and to the front and is there of flat shape.

18. Cyclist's shoe in accordance with claim 17, characterized in that said reinforcement insert has flat support regions alongside the attachment region.

19. Cyclist's shoe in accordance with claim 18, characterized in that said flat support regions are flush with the upper side of the attachment region and extend into the edge region of the sole.

20. Cyclist's shoe in accordance with claim 19, characterized in that said support regions having anchorage bores or anchorage spigots which from a fixedly anchored connection with the soft material of the sole.

21. Cyclist's shoe in accordance with claim 20, characterized in that a forwardly disposed flat support region is provided around said edge portion which surrounds the front recess.

22. Cyclist's shoe in accordance with claim 21, characterized in that said forwardly disposed flat support region is flush with the upper side of the attachment region.

23. Cyclist's shoe in accordance with claim 22, characterized in that a flat extension portion of said reinforcement insert has a rear support region which is aligned at the top substantially with the upper side of the insert at the attachment region.

24. Cyclist's shoe in accordance with claim 27, characterized in that said rear support region projects slightly upwardly relative to the upper side of the insert at the attachment region, adjoins the attachment region at the rear end thereof and upwardly bounds a rear recess for receiving the pedal latch.

25. Cyclist's shoe in accordance with claim 24, characterized in that said rear support region extends approximately to the center of the shoe as seen in the direction of the longitudinal axis of the shoe.

26. Cyclist's shoe in accordance with claim 28, characterized in that anchorage bores or anchorage spigots are located in the rear support region which fixedly anchor the reinforcement insert and the sole to one another.

27. Cyclist's shoe in accordance with claim 1, characterized in that a cover plate is provided in the region of the pedal plate and is releasably securable to the latter.

28. Cyclist's shoe in accordance with claim 27, characterized in that said cover plate is capable of being clipped onto said pedal plate.

29. Cyclist's shoe in accordance with claim 28, characterized in that said cover plate at least largely covers over said front recess.

30. Cyclist's shoe in accordance with claim 27, characterized in that the pedal plate is formed in one piece with the cover plate; and in that the part so formed is securable to the shoe sole.

31. Cyclist's shoe in accordance with claim 30, characterized in that said cover plate is screwable to said shoe sole instead of a pedal plate which cooperates with the cycle safety pedal.

32. Cyclist's shoe in accordance with claim 9, characterized in that the reinforcement insert consists of hard elastic plastic and as metal inserts containing the threaded bores.

33. Cyclist's shoe in accordance with claim 9, characterized in that the reinforcement insert consists of metal and is thickened in the region of the threaded bores.

34. Cyclist's shoe for releasable engagement with a cycle safety pedal having a pedal latch and an engagement projection, said shoe comprising a sole including a recess, a pedal plate disposed in the recess and having a thickness such that the pedal plate does not substantially project downwardly beyond the sole, the recess having a size and shape to form free spaces about portions of the pedal plate adapted to accommodate the pedal latch and the engagement projection where they are in operative engagement with the pedal plate.

* * * * *